US006500023B1

(12) United States Patent
Duong et al.

(10) Patent No.: US 6,500,023 B1
(45) Date of Patent: Dec. 31, 2002

(54) ELECTRICAL CONNECTOR WITH A HANDLE

(75) Inventors: Nina Duong, Irvine, CA (US); Tadashi Ishiwa, Irvine, CA (US)

(73) Assignee: Jae Electronics, Inc., Irvine, CA (US)

( * ) Notice: Subject to any disclaimer, the term of this patent is extended or adjusted under 35 U.S.C. 154(b) by 43 days.

(21) Appl. No.: 09/664,392

(22) Filed: Sep. 19, 2000

(51) Int. Cl.[7] ..... H01R 13/00
(52) U.S. Cl. ..... 439/484; 439/476.1
(58) Field of Search ..... 439/484, 476.1, 439/493, 496, 266, 696, 477

(56) References Cited

U.S. PATENT DOCUMENTS 4,881,911 A * 11/1989 Haddock et al. ..... 439/484
4,927,376 A * 5/1990 Dickie ..... 439/484
5,567,181 A * 10/1996 Lentz et al. ..... 439/694

* cited by examiner

*Primary Examiner*—P. Austin Bradley
*Assistant Examiner*—Alexander Gilman
(74) *Attorney, Agent, or Firm*—Koda & Androlia

(57) ABSTRACT

An electrical connector for a cable such as a ribbon cable used in an electronic instrument. The electrical connector plugged into a connector of a printed circuit-board of, for instance, a notebook computer has substantially an inverted U-shaped handle with its pair of leg elements being engaged with socket elements formed in the sides of the connector. The leg elements are bent at about the mid points so as to reduce the height of the handle, thus allowing the handle to be fit within narrow interior space of the notebook computer.

4 Claims, 3 Drawing Sheets

ELECTRICAL CONNECTOR WITH A HANDLE

BACKGROUND OF THE INVENTION

1. Filed of the Invention

The present invention relates to an electrical connector and more particularly to an electrical connector having a handle for facilitating removal of the connector from a printed circuit-board of an electronic instrument such as a notebook computer.

2. Prior Art

In small electronic instruments such as a notebook computer, a personal digital assistant (PDA), etc, a flexible printed circuit or a so-called flat ribbon cable is used. Such a circuit or a cable is attached to an electrical connector that is mated to a connector mounted on a printed circuit-board or a motherboard of the electronic instrument. Such electronic instruments are recently designed as small as possible so as to be easily carried to places. As a result, the internal space is severely limited, and devices installed in such a limited space are designed to be compact. Thus, a connector body of the electrical connector installed in such a limited space of, for instance, notebook computers is designed as compact as possible. This causes several problems. One of the problems is that pulling out or unplugging of such a compact component, for instance, an electrical connector with a cable, from the connector of the printed circuit-board of a notebook computer is very difficult. When such a component is forced to be unplugged in an awkward fashion, the component can be easily broken.

SUMMARY OF THE INVENTION

Accordingly, the object of the present invention is to provide a structure that facilitates removal of an electronic component such as an electrical connector used in a small size electronic instrument such as a notebook computer, a personal digital assistant (PDA), etc.

The above object is accomplished by a unique structure for an electrical connector (merely called "connector") that has a removing means from a limited space.

More specifically, the connector of the present invention is comprised of a connector body and substantially an inverted U-shaped handle body with its pair of leg elements being engaged with socket elements formed on the connector body to which a cable such as a ribbon cable is connected. The leg elements can be bent at substantially mid points thereof so as to reduce the height of the handle body to be installed in narrow interior space of, for instance, a notebook computer.

With the structure above, the connector engaged with the connector of a printed circuit-board of, for instance, a notebook computer can be easily unplugged by way of pulling the handle body attached to the connector body and not by pulling the connector body or the cable so that damage to the connector, the cable or the connector of the printed circuit-board is prevented. In addition, with the bent leg elements, the height of the handle body can be low so that the connector can fit within the limited interior space of compact electronic equipment, such as a notebook computer.

BRIEF DESCRIPTION OF THE DRAWINGS

FIG. 2(*b*) is a side view thereof;

FIG. 3(*b*) is a side view thereof;

FIG. 4(*b*) is a side view thereof.

DETAILED DESCRIPTION OF THE PREFERRED EMBODIMENTS

Figure 1:
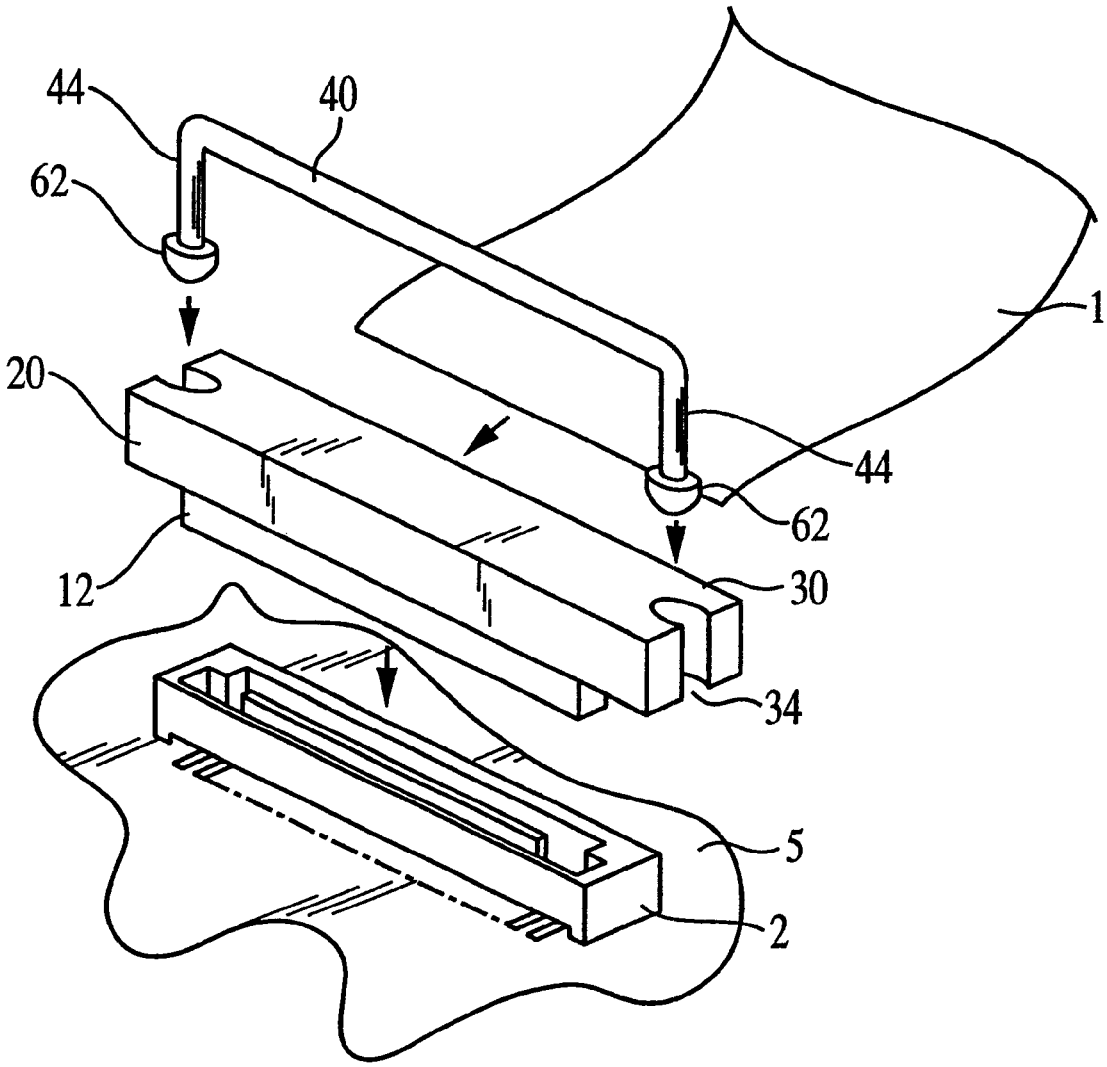
FIG. 1 is an exploded perspective view of the electrical connector according to the present invention.
Figure 2A:
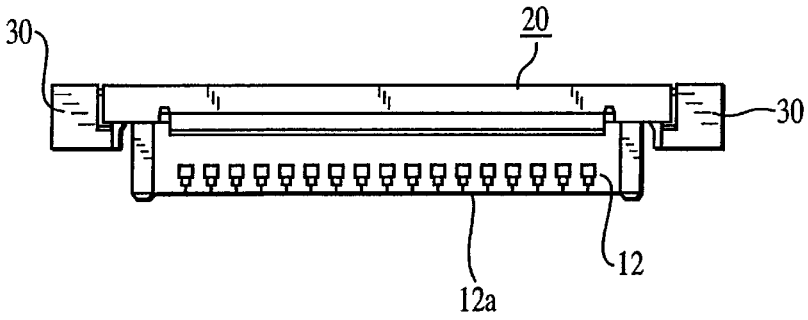
FIG. 2(*a*) is a front lavational view of the connector body.
Figure 2B:
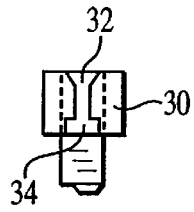

The connector or a removing structure for the connector of the present invention comprises a connector body 20 and a handle body 40.

The connector body 20 is in substantially a rectangular parallelepiped shape made of plastic or PVC (polyvinyl chloride) with longer sides to be oriented in a horizontal direction. The connector body 20 is provide with a terminal 12; and when the connector is plugged into the connector 2 of a printed circuit-board (PCB) or mother board 5 of, for instance, a notebook computer, the terminal 12 is mated and engaged with the connector 2 of the PCB 5. A flexible printed circuit or a flat ribbon cable 1 is securely connected at its end to the connector body 20 so that an electrical connection is made between the cable 1 and the terminal 12 inside the connector body 20. The cable 1 can be a wire cable.

The connector body 20 is integrally formed at both ends or opposite side ends thereof with socket elements 30. Each of the socket elements 30 is substantially a cylinder and is formed with a central through hole 32 that extends in a direction perpendicular to the longer sides of the connector body 20. The socket element 30 is further formed with a longitudinal slit or an opening 34 so that the slit 34 is located on a diametrically opposite side from the side end of the connector body 20.

The handle body 40, which can be made of the same material as that of the connector body as a whole, is shaped in substantially an inverted U-shape. The inverted U-shaped handle body 40 comprises a handle element 42 that is substantially horizontally disposed and a pair of leg elements 44 that extend from both ends of the horizontal handle element 42 at substantially right angles as noted at 42*a*.

Lower leg portion 60 of each one of the leg elements 44 has substantially the same or slightly smaller diameter than the diameter of each one the central through holes 32 of the socket elements 30 of the connector body 20. The leg elements 44 are designed so as to be longer than the length or height of the socket elements 30 of the connector body 20.

Figure 3A:
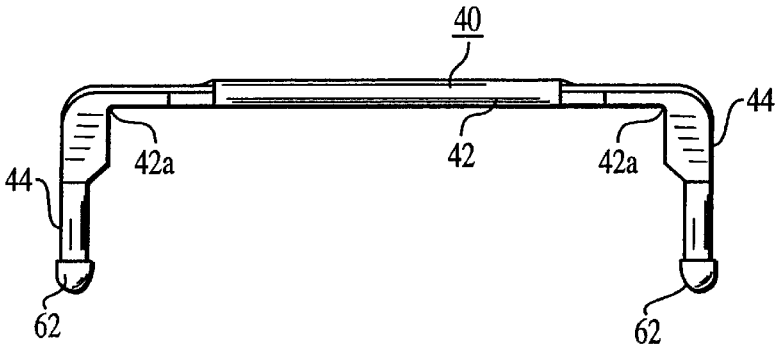
FIG. 3(*a*) is a front elevational view of the handle body to be engaged with the connector body.
Figure 3B:
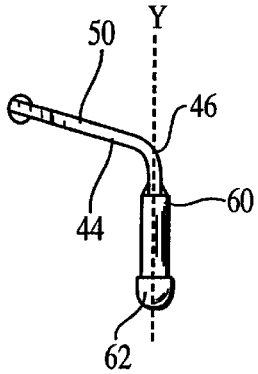

In the handle body 40 shown in FIG. 3(*b*), each of the leg elements 44 is bent at substantially a mid point 46 thereof so as to have an upper leg portion 50 and a lower leg portion 60. As seen from FIG. 3(*b*), the upper leg portion 50 is at an angle of about 75 degrees with reference to the imaginary line Y or vertical axis of the leg element 44. In other words, each of the leg elements 44 is bent at its mid point 46 at an angle of about 105 degrees as best seen from FIG. 3(*b*) that is a side view of the handle body 40 so as to define the upper leg portion 50 and the lower leg portion 60. In the embodiment shown in FIGS. 3(*a*) and 3(*b*), the lower leg portion 60 is longer than the length or height of the socket elements 30 of the connector body 20.

At the end of each one of the leg elements 44, a bulged portion 62 is integrally formed. The bulged portion 62 is of a hemispherical shape with its convex surface facing opposite from the handle element 42 and its flat surface facing the handle element 42. The bulged portion 62 has a larger diameter than each of the central through holes 32 of the socket elements 30.

Figure 4A:
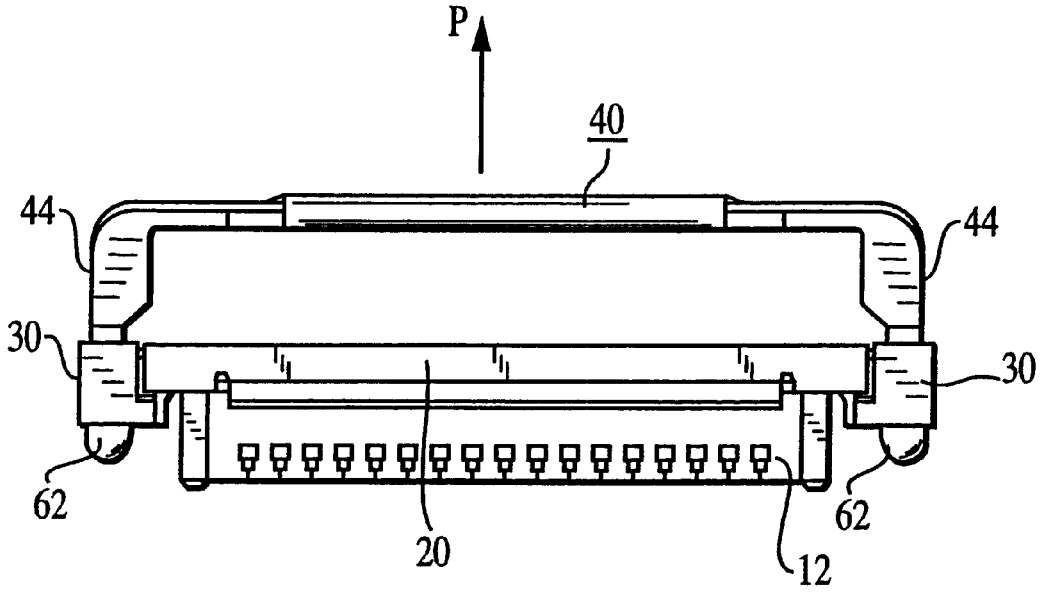
FIG. 4(*a*) is a front elevational view of the handle body engaged with the connector body.
Figure 4B:
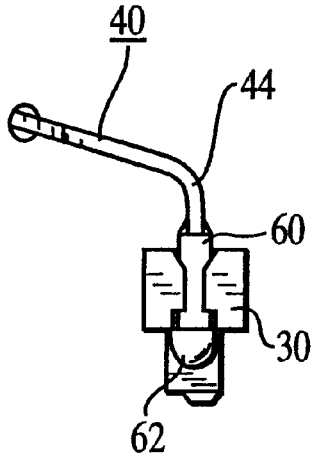

With the flat or upper surface of one of the hemispherical bulged portion 62 being brought into contact with the bottom of one the socket elements 30 of the connector body 20, one of the leg elements 44 or the lower leg portion 60 of one of the leg elements 44 is pushed into the central through hole 32 through the vertical slit 34 of one of the socket elements 30. Then, with the flat surface of the other bulged portion 62 being brought into contact with the bottom of another socket element 30, another one of the leg elements 44 or the lower leg portion 60 of another one of the leg elements 44 is pushed into the central through hole 32 through the vertical slit 34 of the other socket element 30. As a result, the leg elements 44 or the lower leg portions 60 of the handle body 40 are elastically engaged with the socket elements 30 and connected to the connector body 20 via its leg elements 44 and the socket elements 30; and the handle body 40 and the connector body 20 form an integral single component as shown in FIGS. 4(*a*) and 4(*b*).

As a result, the connector body 20 with the handle body 40 attached thereto is plugged into the connector 2 of the PCB 5 by pushing the handle element 42 of the handle body 40 or pushing the connector body 20 to the connector 2. In the embodiment of FIG. 3(*a*) and 3(*b*), since the upper leg portions 50 of the leg elements 44 of the handle body 40 are at about 105 degrees with reference to the lower leg portion 60, the handle body 40 is low (and is lower than the structure shown in FIG. 1) in height and can fit in a limited small space in, for instance, a notebook computer. When unplugging the connector body 20 from the connector 2 of the PCB 5, the handle element 42 is held by fingers and pulled in the direction opposite from the connector as shown by an arrow P in FIG. 4(*a*). Since the bulged portions 62 of the leg elements 44 of the handle body 40 are lager in diameter than the central through holes 32 of the socket elements 30 of the connector body 20, the bulged portions 62 are kept in contact with the (lower) end surfaces of the socket elements 30, and the leg elements 44 of the handle body 40 are avoided from disengaging from the socket elements 30. As a result, the connector body 20 can be removed from the PCB 5 without being damaged and without damaging the terminal 12, the connector 2 of the PCB 5 and the cable 1.

In the shown embodiments, the leg elements 44 are bent so that the upper leg portion 50 and the lower leg portion 60 are defined at about 105 degrees apart relative to each other. However, it goes without saying the leg elements 44 can be bent at any desired angle that can provide an easy holding of the handle element 42 by fingers and that keep the height of the handle body 40 low.

The present invention is described with reference to a notebook computer; however, it should be noted that the present invention is applicable to, for instance, desktop computers and other larger size electronic equipment than notebook computers.

It should be apparent to those skilled in the art that the above-described embodiments merely illustrative of but a few of the many possible specific embodiments which represent the applications of the principles of the present invention. Numerous and varied other arrangement can readily devised by those skilled in the art without departing from the spirit and scope of the present invention.

What is claimed is:

1. An electrical connector comprising:

a connector body to which a cable is connected;

a pair of socket elements provided at both ends of said connector body, each of said socket elements comprising a cylindrical through hole formed in said connector body adjacent opposite edges thereof and a slit formed in said cylindrical hole extending through said edge of said connector body; and a substantially rigid of substantially an inverted U-shape having a handle element substantially horizontally disposed and a pair of leg elements extending from both ends of said handle element, each of said leg element being formed at an end thereof with a bulged portion and not rotatably engaged with each of said socket elements of said connector body; and wherein each of said leg elements is bent at substantially a mid point thereof so as to form an upper leg portion and a lower leg portion, said lower leg portion being engaged with said socket element, and said bulged portion being provided on an end of said lower leg portion;

said bulged portion has a diameter larger than a diameter of said cylindrical through hole of said socket element to prevent each of said leg elements from disengaging from said socket element;

said upper leg portion is at an angle of substantially 105 degrees with respect to said lower leg portion;

said bulged portion of said handle body is in contact with an end surface of said socket element;

a width of at least a portion of each of said slit is less than said diameter of said lower leg portion; and said handle body is made from a plastic.

2. The electric connector according to claim 1, wherein said cable is a flexible printed circuit.

3. The electric connector according to claim 1, wherein said cable is a flat ribbon cable.

4. The electric connector according to claim 1, wherein said cable is a wire cable.

* * * * *